US011338260B2

(12) United States Patent
Weeter et al.

(10) Patent No.: US 11,338,260 B2
(45) Date of Patent: May 24, 2022

(54) VACUUM PARTICULATE RECOVERY SYSTEMS FOR BULK MATERIAL CONTAINERS

(71) Applicant: Halliburton Energy Services, Inc., Houston, TX (US)

(72) Inventors: Phillip Weeter, Kalkaska, MI (US); Bryan Lucas Chapman, Duncan, OK (US); Austin Carl Schaffner, Duncan, OK (US); Wesley John Warren, Marlow, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 635 days.

(21) Appl. No.: 16/314,764

(22) PCT Filed: Aug. 15, 2016

(86) PCT No.: PCT/US2016/046986
§ 371 (c)(1),
(2) Date: Jan. 2, 2019

(87) PCT Pub. No.: WO2018/034641
PCT Pub. Date: Feb. 22, 2018

(65) Prior Publication Data
US 2020/0038825 A1 Feb. 6, 2020

(51) Int. Cl.
*B01F 35/00* (2022.01)
*B01F 23/50* (2022.01)
(Continued)

(52) U.S. Cl.
CPC ..... *B01F 35/184* (2022.01); *B01F 23/59* (2022.01); *B01F 35/71731* (2022.01);
(Continued)

(58) Field of Classification Search
CPC ..... B01F 2215/0081; B01F 5/00961; B01F 35/184; B01F 23/59; B01F 35/71731;
(Continued)

(56) References Cited

U.S. PATENT DOCUMENTS 710,611 A 10/1902 Ray
802,254 A 10/1905 Baker et al.
(Continued)

FOREIGN PATENT DOCUMENTS

EP 0511788 A1 11/1992
EP 2937826 A1 10/2015
(Continued)

OTHER PUBLICATIONS

EP 0511 788 to Allen (Year: 1992).*
(Continued)

*Primary Examiner* — Anshu Bhatia
(74) *Attorney, Agent, or Firm* — Conley Rose, P.C.; Rodney B. Carroll

(57) ABSTRACT

Systems and methods for recovering dry bulk material from a blender at a job site are provided. The systems include at least one container having in which dry bulk material can be placed and a skid-mounted vacuum unit comprising a tank having an interior space and an outlet for interfacing with the inlet of the container when the vacuum unit is positioned proximate to the container, a vacuum pump in communication with the interior space of the tank, and a conduit coupled to an inlet of the vacuum pump for interfacing with an inlet of a blender.

20 Claims, 5 Drawing Sheets

(51) Int. Cl.

| | |
|---|---|
| ***B01F 35/71*** | (2022.01) |
| *E21B 43/04* | (2006.01) |
| *E21B 43/267* | (2006.01) |
| *B01F 101/49* | (2022.01) |

(52) U.S. Cl.
CPC .... *B01F 35/71805* (2022.01); *B01F 2101/49* (2022.01); *E21B 43/04* (2013.01); *E21B 43/267* (2013.01)

(58) Field of Classification Search
CPC ..... B01F 35/71805; B01F 2101/49; E21B 43/04; E21B 43/267
See application file for complete search history.

(56) References Cited

U.S. PATENT DOCUMENTS

| | | | |
|---|---|---|---|
| 917,646 | A | 4/1909 | Otto |
| 1,519,153 | A | 12/1924 | Mitton |
| 1,726,603 | A | 9/1929 | Allen |
| 1,795,987 | A | 3/1931 | Adams |
| 2,231,911 | A | 2/1941 | Hitt et al. |
| 2,281,497 | A | 4/1942 | Hyson et al. |
| 2,385,245 | A | 9/1945 | Willoughby |
| 2,415,782 | A | 2/1947 | Zademach et al. |
| 2,513,012 | A | 6/1950 | Dugas |
| 2,563,470 | A | 8/1951 | Kane |
| 2,652,174 | A | 9/1953 | Shea |
| 2,670,866 | A | 3/1954 | Glesby |
| 2,678,737 | A | 5/1954 | Mangrum |
| 2,759,737 | A | 8/1956 | Manning |
| 2,802,603 | A | 8/1957 | McCray |
| 2,867,336 | A | 1/1959 | Soldini et al. |
| 3,049,248 | A | 8/1962 | Heltzel et al. |
| 3,083,879 | A | 4/1963 | Coleman |
| 3,151,779 | A | 10/1964 | Rensch et al. |
| 3,203,370 | A | 8/1965 | Friedrich et al. |
| 3,217,927 | A | 11/1965 | Bale, Jr. et al. |
| 3,318,473 | A | 5/1967 | Jones et al. |
| 3,326,572 | A | 6/1967 | Murray |
| 3,343,688 | A | 9/1967 | Ross |
| 3,354,918 | A | 11/1967 | Coleman |
| 3,380,333 | A | 4/1968 | Clay et al. |
| 3,404,963 | A | 10/1968 | Fritsche et al. |
| 3,410,530 | A | 11/1968 | Gilman |
| 3,432,151 | A | 3/1969 | O'Loughlin et al. |
| 3,467,408 | A | 9/1969 | Regalia |
| 3,476,270 | A | 11/1969 | Cox et al. |
| 3,602,400 | A | 8/1971 | Cooke |
| 3,627,555 | A | 12/1971 | Driscoll |
| 3,698,693 | A | 10/1972 | Poncet |
| 3,785,534 | A | 1/1974 | Smith |
| 3,802,584 | A | 4/1974 | Sackett, Sr. et al. |
| 3,986,708 | A | 10/1976 | Heltzel et al. |
| 4,019,641 | A | 4/1977 | Merz |
| 4,023,719 | A | 5/1977 | Noyon |
| 4,058,239 | A | 11/1977 | Van Mill |
| 4,138,163 | A | 2/1979 | Calvert et al. |
| 4,178,117 | A | 12/1979 | Brugler |
| 4,204,773 | A | 5/1980 | Bates |
| 4,248,337 | A | 2/1981 | Zimmer |
| 4,258,953 | A | 3/1981 | Johnson |
| 4,313,708 | A | 2/1982 | Tiliakos |
| 4,395,052 | A | 7/1983 | Rash |
| 4,398,653 | A | 8/1983 | Daloisio |
| 4,423,884 | A | 1/1984 | Gevers |
| 4,544,279 | A | 10/1985 | Rudolph |
| 4,548,507 | A | 10/1985 | Mathis et al. |
| 4,583,663 | A | 4/1986 | Bonerb |
| 4,626,166 | A | 12/1986 | Jolly |
| 4,701,095 | A | 10/1987 | Berryman et al. |
| 4,806,065 | A | 2/1989 | Holt et al. |
| 4,850,702 | A | 7/1989 | Arribau et al. |
| 4,856,681 | A | 8/1989 | Murray |
| 4,900,157 | A | 2/1990 | Stegemoeller et al. |
| 4,919,540 | A | 4/1990 | Stegemoeller et al. |
| 4,956,821 | A | 9/1990 | Fenelon |
| 4,993,883 | A | 2/1991 | Jones |
| 4,997,335 | A | 3/1991 | Prince |
| 5,036,979 | A | 8/1991 | Selz |
| 5,096,096 | A | 3/1992 | Calaunan |
| 5,114,169 | A | 5/1992 | Botkin et al. |
| 5,149,192 | A | 9/1992 | Hamm et al. |
| 5,303,998 | A | 4/1994 | Whitlatch et al. |
| 5,339,996 | A | 8/1994 | Dubbert et al. |
| 5,343,813 | A | 9/1994 | Septer |
| 5,375,730 | A | 12/1994 | Bahr et al. |
| 5,401,129 | A | 3/1995 | Eatinger |
| 5,413,154 | A | 5/1995 | Hurst, Jr. et al. |
| 5,426,137 | A | 6/1995 | Allen |
| 5,441,321 | A | 8/1995 | Karpisek |
| 5,443,350 | A | 8/1995 | Wilson |
| 5,445,289 | A | 8/1995 | Owen |
| 5,590,976 | A | 1/1997 | Kilheffer et al. |
| 5,609,417 | A | 3/1997 | Otte |
| 5,722,552 | A | 3/1998 | Olson |
| 5,772,390 | A | 6/1998 | Walker |
| 5,806,441 | A | 9/1998 | Chung |
| 5,913,459 | A | 6/1999 | Gill et al. |
| 5,915,913 | A | 6/1999 | Greenlaw et al. |
| 5,927,356 | A | 7/1999 | Henderson |
| 5,944,470 | A | 8/1999 | Bonerb |
| 5,997,099 | A | 12/1999 | Collins |
| 6,059,372 | A | 5/2000 | McDonald et al. |
| 6,112,946 | A | 9/2000 | Bennett et al. |
| 6,126,307 | A | 10/2000 | Black et al. |
| 6,193,402 | B1 | 2/2001 | Grimland et al. |
| 6,247,594 | B1 | 6/2001 | Garton |
| 6,379,086 | B1 | 4/2002 | Goth |
| 6,425,627 | B1 | 7/2002 | Gee |
| 6,491,421 | B2 | 12/2002 | Rondeau et al. |
| 6,517,232 | B1 | 2/2003 | Blue |
| 6,536,939 | B1 | 3/2003 | Blue |
| 6,537,015 | B2 | 3/2003 | Lim et al. |
| 6,568,567 | B2 | 5/2003 | McKenzie et al. |
| 6,622,849 | B1 | 9/2003 | Sperling |
| 6,876,904 | B2 | 4/2005 | Oberg et al. |
| 7,008,163 | B2 | 3/2006 | Russell |
| 7,086,342 | B2 | 8/2006 | O'Neall et al. |
| 7,100,896 | B1 | 9/2006 | Cox |
| 7,114,905 | B2 | 10/2006 | Dibdin |
| 7,252,309 | B2 | 8/2007 | Eng Soon et al. |
| 7,284,579 | B2 | 10/2007 | Elgan |
| 7,451,015 | B2 | 11/2008 | Mazur et al. |
| 7,475,796 | B2 | 1/2009 | Garton |
| 7,500,817 | B2 | 3/2009 | Furrer et al. |
| 7,513,280 | B2 | 4/2009 | Brashears et al. |
| 7,665,788 | B2 | 2/2010 | Dibdin et al. |
| 7,762,281 | B2 | 7/2010 | Schuld |
| 7,997,213 | B1 | 8/2011 | Gauthier et al. |
| 8,387,824 | B2 | 3/2013 | Wietgrefe |
| 8,434,990 | B2 | 5/2013 | Claussen |
| D688,349 | S | 8/2013 | Oren et al. |
| D688,350 | S | 8/2013 | Oren et al. |
| D688,351 | S | 8/2013 | Oren et al. |
| D688,772 | S | 8/2013 | Oren et al. |
| 8,505,780 | B2 | 8/2013 | Oren |
| 8,545,148 | B2 | 10/2013 | Wanek-Pusset et al. |
| 8,573,917 | B2 | 11/2013 | Renyer |
| 8,585,341 | B1 | 11/2013 | Oren |
| 8,607,289 | B2 | 12/2013 | Brown et al. |
| 8,616,370 | B2 | 12/2013 | Allegretti et al. |
| 8,622,251 | B2 | 1/2014 | Oren |
| 8,662,525 | B1 | 3/2014 | Dierks et al. |
| 8,668,430 | B2 | 3/2014 | Oren et al. |
| D703,582 | S | 4/2014 | Oren |
| 8,827,118 | B2 | 9/2014 | Oren |
| 8,834,012 | B2 | 9/2014 | Case et al. |
| 8,882,428 | B2 | 11/2014 | Fikes et al. |
| 8,887,914 | B2 | 11/2014 | Allegretti et al. |
| RE45,713 | E | 10/2015 | Oren et al. |
| 9,162,603 | B2 | 10/2015 | Oren |
| RE45,788 | E | 11/2015 | Oren et al. |
| 9,248,772 | B2 | 2/2016 | Oren |

(56) References Cited

U.S. PATENT DOCUMENTS

| | | | |
|---|---|---|---|
| RE45,914 | E | 3/2016 | Oren et al. |
| 9,296,518 | B2 | 3/2016 | Oren |
| 9,340,353 | B2 | 5/2016 | Oren et al. |
| 9,358,916 | B2 | 6/2016 | Oren |
| 9,394,102 | B2 | 7/2016 | Oren et al. |
| 9,403,626 | B2 | 8/2016 | Oren |
| 9,421,899 | B2 | 8/2016 | Oren |
| 9,440,785 | B2 | 9/2016 | Oren et al. |
| 9,446,801 | B1 | 9/2016 | Oren |
| 9,475,661 | B2 | 10/2016 | Oren |
| 9,511,929 | B2 | 12/2016 | Oren |
| 9,522,816 | B2 | 12/2016 | Taylor |
| 9,527,664 | B2 | 12/2016 | Oren |
| 9,580,238 | B2 | 2/2017 | Friesen et al. |
| RE46,334 | E | 3/2017 | Oren et al. |
| 9,617,065 | B2 | 4/2017 | Allegretti et al. |
| 9,617,066 | B2 | 4/2017 | Oren |
| 9,624,030 | B2 | 4/2017 | Oren et al. |
| 9,624,036 | B2 | 4/2017 | Luharuka et al. |
| 9,643,774 | B2 | 5/2017 | Oren |
| 9,650,216 | B2 | 5/2017 | Allegretti |
| 9,656,799 | B2 | 5/2017 | Oren et al. |
| 9,669,993 | B2 | 6/2017 | Oren et al. |
| 9,670,752 | B2 | 6/2017 | Glynn et al. |
| 9,676,554 | B2 | 6/2017 | Glynn et al. |
| 9,682,815 | B2 | 6/2017 | Oren |
| 9,694,970 | B2 | 7/2017 | Oren et al. |
| 9,701,463 | B2 | 7/2017 | Oren et al. |
| 9,718,609 | B2 | 8/2017 | Oren et al. |
| 9,718,610 | B2 | 8/2017 | Oren |
| 9,725,233 | B2 | 8/2017 | Oren et al. |
| 9,725,234 | B2 | 8/2017 | Oren et al. |
| 9,738,439 | B2 | 8/2017 | Oren et al. |
| RE46,531 | E | 9/2017 | Oren et al. |
| 9,758,081 | B2 | 9/2017 | Oren |
| 9,758,993 | B1 | 9/2017 | Allegretti et al. |
| 9,771,224 | B2 | 9/2017 | Oren et al. |
| 9,783,338 | B1 | 10/2017 | Allegretti et al. |
| 9,796,319 | B1 | 10/2017 | Oren |
| 9,796,504 | B1 | 10/2017 | Mlegretti et al. |
| 9,809,381 | B2 | 11/2017 | Oren et al. |
| 9,828,135 | B2 | 11/2017 | Allegretti et al. |
| 9,840,366 | B2 | 12/2017 | Oren et al. |
| 9,969,564 | B2 | 5/2018 | Oren et al. |
| 9,988,182 | B2 | 6/2018 | Allegretti et al. |
| 10,059,246 | B1 | 8/2018 | Oren |
| 10,081,993 | B2 | 9/2018 | Walker et al. |
| 10,189,599 | B2 | 1/2019 | Allegretti et al. |
| 10,207,753 | B2 | 2/2019 | O'Marra et al. |
| 10,287,091 | B2 | 5/2019 | Allegretti |
| 10,308,421 | B2 | 6/2019 | Allegretti |
| 10,486,854 | B2 | 11/2019 | Allegretti et al. |
| 10,518,828 | B2 | 12/2019 | Oren et al. |
| 10,604,338 | B2 | 3/2020 | Allegretti |
| 2002/0121464 | A1 | 9/2002 | Soldwish-Zoole et al. |
| 2003/0159310 | A1 | 8/2003 | Hensley et al. |
| 2004/0008571 | A1 | 1/2004 | Coody et al. |
| 2004/0031335 | A1 | 2/2004 | Fromme et al. |
| 2004/0206646 | A1 | 10/2004 | Goh et al. |
| 2004/0258508 | A1 | 12/2004 | Jewell |
| 2005/0219941 | A1 | 10/2005 | Christenson et al. |
| 2006/0013061 | A1 | 1/2006 | Bivens et al. |
| 2007/0014185 | A1 | 1/2007 | Diosse et al. |
| 2007/0201305 | A1 | 8/2007 | Heilman et al. |
| 2008/0187423 | A1 | 8/2008 | Mauchle |
| 2008/0294484 | A1 | 11/2008 | Furman et al. |
| 2009/0078410 | A1 | 3/2009 | Krenek et al. |
| 2009/0129903 | A1 | 5/2009 | Lyons, III |
| 2009/0292572 | A1 | 11/2009 | Alden et al. |
| 2009/0314791 | A1 | 12/2009 | Hartley et al. |
| 2010/0038077 | A1 | 2/2010 | Heilman et al. |
| 2010/0196129 | A1* | 8/2010 | Buckner ..... E02F 3/94 414/467 |
| 2010/0319921 | A1 | 12/2010 | Eia et al. |
| 2012/0017812 | A1 | 1/2012 | Renyer et al. |
| 2012/0018093 | A1 | 1/2012 | Zuniga et al. |
| 2012/0020747 | A1 | 1/2012 | Schneider et al. |
| 2012/0037231 | A1 | 2/2012 | Janson |
| 2012/0181093 | A1 | 7/2012 | Fehr et al. |
| 2012/0219391 | A1 | 8/2012 | Teichrob et al. |
| 2013/0128687 | A1 | 5/2013 | Adams |
| 2013/0135958 | A1 | 5/2013 | O'Callaghan |
| 2013/0142601 | A1 | 6/2013 | McIver et al. |
| 2013/0206415 | A1 | 8/2013 | Sheesley |
| 2013/0284729 | A1 | 10/2013 | Cook et al. |
| 2014/0023463 | A1 | 1/2014 | Oren |
| 2014/0044508 | A1 | 2/2014 | Luharuka et al. |
| 2014/0076569 | A1 | 3/2014 | Pham et al. |
| 2014/0083554 | A1 | 3/2014 | Harris |
| 2014/0216736 | A1 | 8/2014 | Leugemors et al. |
| 2014/0305769 | A1 | 10/2014 | Eiden, III et al. |
| 2014/0377042 | A1 | 12/2014 | McMahon |
| 2015/0003955 | A1 | 1/2015 | Oren et al. |
| 2015/0016209 | A1 | 1/2015 | Barton et al. |
| 2015/0183578 | A9 | 7/2015 | Oren et al. |
| 2015/0191318 | A1 | 7/2015 | Martel |
| 2015/0284194 | A1 | 10/2015 | Oren et al. |
| 2015/0353293 | A1 | 12/2015 | Richard |
| 2015/0366405 | A1 | 12/2015 | Manchuliantsau |
| 2015/0368052 | A1 | 12/2015 | Sheesley |
| 2015/0375930 | A1 | 12/2015 | Oren et al. |
| 2016/0031658 | A1 | 2/2016 | Oren et al. |
| 2016/0039433 | A1 | 2/2016 | Oren et al. |
| 2016/0046438 | A1 | 2/2016 | Oren et al. |
| 2016/0046454 | A1 | 2/2016 | Oren et al. |
| 2016/0068342 | A1 | 3/2016 | Oren et al. |
| 2016/0130095 | A1 | 5/2016 | Oren et al. |
| 2016/0244279 | A1 | 8/2016 | Oren et al. |
| 2016/0264352 | A1 | 9/2016 | Oren |
| 2016/0332809 | A1 | 11/2016 | Harris |
| 2016/0332811 | A1 | 11/2016 | Harris |
| 2017/0021318 | A1 | 1/2017 | McIver et al. |
| 2017/0123437 | A1 | 5/2017 | Boyd et al. |
| 2017/0129696 | A1 | 5/2017 | Oren |
| 2017/0144834 | A1 | 5/2017 | Oren et al. |
| 2017/0190523 | A1 | 7/2017 | Oren et al. |
| 2017/0203915 | A1 | 7/2017 | Oren |
| 2017/0217353 | A1 | 8/2017 | Pol et al. |
| 2017/0217671 | A1 | 8/2017 | Allegretti |
| 2017/0225883 | A1 | 8/2017 | Oren |
| 2017/0240350 | A1 | 8/2017 | Oren et al. |
| 2017/0240361 | A1 | 8/2017 | Glynn et al. |
| 2017/0240363 | A1 | 8/2017 | Oren |
| 2017/0267151 | A1 | 9/2017 | Oren |
| 2017/0283165 | A1 | 10/2017 | Oren et al. |
| 2017/0313497 | A1 | 11/2017 | Schaffner et al. |
| 2017/0320660 | A1 | 11/2017 | Sanders et al. |
| 2017/0349226 | A1 | 12/2017 | Oren et al. |
| 2018/0002120 | A1 | 1/2018 | Allegretti et al. |
| 2018/0257814 | A1 | 9/2018 | Allegretti et al. |
| 2019/0009231 | A1 | 1/2019 | Warren et al. |
| 2019/0111401 | A1 | 4/2019 | Lucas et al. |
| 2020/0062448 | A1 | 2/2020 | Allegretti et al. |

FOREIGN PATENT DOCUMENTS

| | | | |
|---|---|---|---|
| GB | 2066220 | A | 7/1981 |
| GB | 2204847 | A1 | 11/1988 |
| JP | 2008239019 | A | 10/2008 |
| WO | 2008012513 | A2 | 1/2008 |
| WO | 2013095871 | A1 | 6/2013 |
| WO | 2013142421 | A1 | 9/2013 |
| WO | 2014018129 | A1 | 1/2014 |
| WO | 2014018236 | A2 | 5/2014 |
| WO | 2015119799 | A1 | 8/2015 |
| WO | 2015191150 | A1 | 12/2015 |
| WO | 2015192061 | A1 | 12/2015 |
| WO | 2016044012 | A1 | 3/2016 |
| WO | 2016160067 | A1 | 10/2016 |
| WO | 2016178691 | A1 | 11/2016 |
| WO | 2016178692 | A1 | 11/2016 |
| WO | 2016178694 | A1 | 11/2016 |
| WO | 2016178695 | A1 | 11/2016 |
| WO | 2017/014768 | A1 | 1/2017 |

(56) References Cited

FOREIGN PATENT DOCUMENTS

| | | | |
|---|---|---|---|
| WO | 2017/014774 | A1 | 1/2017 |
| WO | 2017014768 | A1 | 1/2017 |
| WO | 2017014771 | A1 | 1/2017 |
| WO | 2017014774 | A1 | 1/2017 |
| WO | 2017027034 | A1 | 2/2017 |

OTHER PUBLICATIONS

International Search Report and Written Opinion issued in related PCT Application No. PCT/US2016/046986 dated May 12, 2017, 17 pages.

* cited by examiner

VACUUM PARTICULATE RECOVERY SYSTEMS FOR BULK MATERIAL CONTAINERS

CROSS-REFERENCE TO RELATED APPLICATION

The present application is a U.S. National Stage Application of International Application No. PCT/US2016/046986 filed Aug. 15, 2016, which is incorporated herein by reference in its entirety for all purposes.

TECHNICAL FIELD

The present disclosure relates generally to transferring solid bulk materials such as proppant, sand, and other particulate materials, and more particularly, to structures that facilitate the recovery of such bulk materials from a blender system.

BACKGROUND

During the drilling and completion of oil and gas wells, various wellbore treating fluids are used for a number of purposes. For example, high viscosity gels are used to create fractures in oil and gas bearing formations to increase production. High viscosity and high density gels are also used to maintain positive hydrostatic pressure in the well while limiting flow of well fluids into earth formations during installation of completion equipment. High viscosity fluids are used to flow proppant or sand into wells during fracturing and gravel packing operations. The high viscosity fluids are normally produced by mixing dry powder and/or particulate materials and agents with water at the well site as they are needed for the particular treatment. Systems for metering and mixing the various materials are normally portable, for example, skid- or truck-mounted, since they are needed for only short periods of time at a well site.

The powder or particulate material is normally transported to a well site in a commercial or common carrier tank truck. Once the tank truck and mixing system are at the well site, the dry bulk material must be transferred or conveyed from the tank truck into a supply tank for metering into a blender as needed. The bulk material is usually transferred from the tank truck pneumatically. More specifically, the bulk material is blown pneumatically from the tank truck into an on-location storage/delivery system (for example, silo). The storage/delivery system may then deliver the bulk material onto a conveyor or into a hopper, which meters the bulk material through a chute into a blender tub.

Recent developments in bulk material handling operations involve the use of portable containers for transporting dry material about a well location. The containers can be brought in on trucks, unloaded, stored on location, and manipulated about the well site when the material is needed. The containers are generally easier to manipulate on location than a large supply tank trailer. The containers are eventually emptied by dumping the contents thereof onto a mechanical conveying system (for example, conveyor belt, auger, bucket lift, etc.). The conveying system then moves the bulk material in a metered fashion to a desired destination at the well site.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
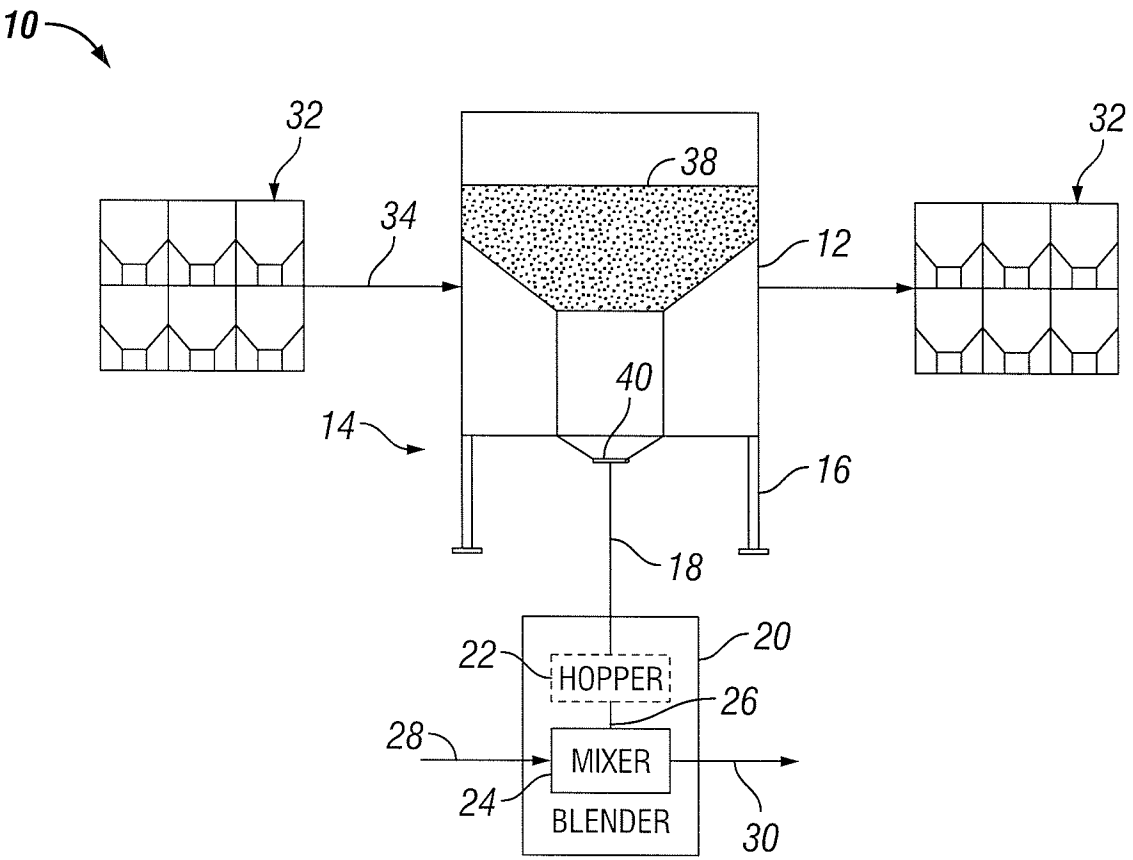
FIG. 1 is a schematic block diagram of a bulk material handling system suitable for releasing bulk material from a container disposed on a support structure, in accordance with one or more aspects of the present disclosure.

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Certain embodiments according to the present disclosure may be directed to systems and methods for efficiently removing or recovering solid bulk material from a blender unit. Bulk material handling systems are used in a wide variety of contexts including, but not limited to, drilling and completion of oil and gas wells, concrete mixing applications, agriculture, and others. The disclosed embodiments are directed to systems and methods for efficiently removing bulk material from a blender unit at a job site. The systems may include a skid-mounted vacuum unit that is configured to be placed on top of a bulk material container and used to remove bulk material remaining in a blender unit after a job and recovering that material into the container. The disclosed techniques may be used to recover any desirable bulk material having a solid constituency including, but not limited to, sand, proppant, gel particulate, diverting agent, dry-gel particulate and others. In certain embodiments, the disclosed techniques may facilitate the removal of solid bulk material from a blender unit while minimizing dust emissions. In certain embodiments, the disclosed techniques may facilitate the recovery of solid bulk material recovered from a blender unit in a form in which it can be readily reused.

In currently existing on-site bulk material handling applications, solid particulate material (e.g., sand, proppant, gel particulate, or dry-gel particulate) may be used during the formation of treatment fluids. In such applications, the bulk material is often transferred between transportation units, storage tanks, blenders, and other on-site components via pneumatic transfer, sand screws, chutes, conveyor belts, and other components. Recently, a method for transferring bulk material to a hydraulic fracturing site involves using portable containers to transport the bulk material. The containers can be brought in on trucks, unloaded, stored on location, and manipulated about the site when the material is needed. These containers generally include a discharge gate at the bottom that can be actuated to empty the material contents of the container at a desired time.

In existing systems, when a job using the bulk material in the blender unit is completed, any bulk material remaining in the blender unit must be removed. Typically this has been accomplished by manually shoveling the dry material out of the blender unit or utilizing a wet vacuum system where a fluid circulated in the unit carries the remaining bulk material out of the unit. Unfortunately, the manual shoveling processes can release a relatively large amount of dust into the air or may result in unintended material spillage. Moreover, because the blender inlet is often elevated from ground level (in some cases, 10 feet above ground level), manual access into the interior of the blender unit may be challenging in some instances. The wet vacuuming processes may reduce some of those risks and challenges, although the bulk material may be contaminated or no longer usable once suspended in the fluid. Such contaminated or unusable bulk material also typically must be disposed in a permissible manner.

The particulate material recovery systems having the structure disclosed herein are designed to address or eliminate certain of the shortcomings associated with existing systems. Particles released into the surrounding air from the discharge of bulk materials at a site or operation may not be desirable. Such discharge of particles may require additional personnel and/or cost to facilitate the collection and disposal of the reclaimed material. For example, with respect to sand, respirable silica dust may be is generated when a sand particle is impacted and damaged causing the particle to be broken into more than one piece. The dust may be generated from the sand falling from one height to another or being mechanically thrusted into another object. For example, the sand may be discharged from an outlet from a container into a chute.

Among the many potential advantages to the methods and compositions of the present disclosure, only some of which are alluded to herein, the methods and systems of the present disclosure may control, minimize or eviscerate the release of this dust to prevent waste and any environmental impact. In certain embodiments, the methods and systems of the present disclosure may facilitate the recovery of bulk material such as sand, proppant, etc. in a form that can be readily reused in subsequent operations without substantial additional preparation. In certain embodiments, the reuse of bulk materials recovered using the methods and systems of the present disclosure may allow avoidance of cost associated with disposing of such bulk materials. In certain embodiments, the solid bulk materials may be recovered in solid form only such that the recovered bulk materials are not mixed with a substantial amount of liquid when recovered.

Turning now to the drawings, FIG. 1 is a block diagram of a bulk material handling system 10 that may be used in accordance with certain embodiments of the present disclosure. The system 10 includes a container 12 elevated on a portable support structure 14 and holding a quantity of solid bulk material 38 (for example, particulate material). For example, the bulk material 38 may comprise a dry solid material that is not mixed or intermingled with a flowable amount of a liquid, or alternatively, that is not mixed or intermingled with a significant amount of a liquid at all. The portable support structure 14 may include a frame 16 for receiving and holding the container 12 and an outlet 18, for example, a gravity feed outlet, for directing bulk material 38 away from the container 12. The outlet 18 may be coupled to and extending from the frame 16. The outlet 18 may utilize a gravity feed to provide a controlled or metered, flow of bulk material 38 from the container 12 to a blender unit 20. In one or more embodiments, outlet 18 may comprise a chute system for guiding discharged bulk material 38 from the container 12 to blender unit 20.

As illustrated, the blender unit 20 may include a hopper 22 and a mixer 24 (for example, a mixing compartment). The blender unit 20 may also include a metering mechanism 26 for providing a controlled or metered flow or discharge of bulk material 38 from the hopper 22 to the mixer 24. However, in other embodiments the blender unit 20 may not include the hopper 22, such that the outlet 18 of the support structure 14 may provide bulk material 38 directly into the mixer 24. In one or more embodiments, blender unit 20 may be any unit or device for collecting the discharged bulk material 38 from the hopper 22 suitable for a given operation.

Water and other additives may be supplied to the mixer 24 (for example, the mixing compartment) through a fluid inlet 28. As those of ordinary skill in the art will appreciate, the fluid inlet 28 may comprise more than the one input flow line illustrated in FIG. 1. The bulk material 38 and a fluid, such as water, or other material may be mixed in the mixer 24 to produce (at an outlet 30) a fracking fluid, a mixture combining multiple types of proppant, proppant/dry-gel particulate mixture, sand/sand-diverting agents mixture, cement slurry, drilling mud, a mortar or concrete mixture, or any other fluid mixture for use on location, for example, at a well site or drilling operation. The outlet 30 may be coupled to a pump for conveying the treating fluid to a desired location (for example, a hydrocarbon recovery well) for a treating process. It should be noted that the disclosed system 10 may be used in other contexts as well. For example, the bulk material handling system 10 may be used in concrete mixing operations (for example, at a construction site) to dispense aggregate from the container 18 through the outlet 22 into a concrete mixing apparatus (mixer 16). In addition, the bulk material handling system 10 may be used in agriculture applications to dispense grain, feed, seed, or mixtures of the same.

It should be noted that the disclosed container 12 may be utilized to provide bulk material 38 for use in a variety of fields, area, or treating processes. For example, the disclosed systems and methods may be utilized to provide proppant materials into fracture treatments performed on a hydrocarbon recovery well. In other embodiments, the disclosed techniques may be used to provide other bulk particulate materials (e.g., particulate diverting agents, gravel, weighting agents, cementitious materials, etc.) for diversions, conductor-frac applications, cement mixing, drilling mud mixing, gravel packing, and other fluid mixing applications. In other embodiments, the disclosed techniques may be used to provide materials for agriculture or land development (such as construction sites for buildings, roads, bridges, or other structures). In one or more embodiments, the container 12 may be open at the top such that bulk material 38 may be exposed. In one or more embodiments, the container 12 may have a top wall (not shown) that has an opening or gate (not shown) to allow the container 12 to be filled with bulk material 38.

As illustrated, the container 12 may be elevated above an outlet location, for example, the outlet 18, via the frame 16. The support structure 14 is designed to elevate the container 12 above the level of the blender inlet (for example, blender hopper 22, mixer 24 or both) to allow the bulk material 38 to gravity feed from the container 12 to the blender unit 20. This way, the container 12 is able to sit on the frame 16 of the support structure 14 and output bulk material 38 directly into the blender unit 20 via the outlet 18 of the support structure 14.

Although shown as supporting a single container 12, other embodiments of the frame 16 may be configured to support multiple containers 12. The exact number of containers 12 that the support structure 14 can hold may depend on a combination of factors such as, for example, the volume, width, and weight of the containers 12 to be disposed thereon and available space.

The container 12 may be completely separable and transportable from the frame 16, such that any container 12 may be selectively removed from the frame 16 and replaced with another container 12. When the bulk material 38 from the container 12 runs low or empties, a new container 12 may be placed on the frame 16 to maintain a steady flow of bulk material 38 to an outlet location. In one or more embodiments, the container 12 may be closed before being completely emptied, removed from the frame 16, and replaced by a container 12 holding a different type of bulk material 38 to be provided to the outlet location.

A storage area 32 may be provided at the site or location for storing one or more additional containers 12 of bulk material 38 to be positioned on the frame 16 of the support structure 14. The containers 12 may be transported to the desired location on a transportation unit (for example, a truck, train, vessel, or any other transport unit). The containers 12 could be stored on the transportation unit itself or on a skid, a pallet, or some other holding area. One or more containers 12 of bulk material 38 may be transferred from the storage area 32 onto the support structure 14, as indicated by arrow 34. This transfer may be performed by lifting the container 12 via a hoisting mechanism, such as a forklift, a crane, or a specially designed container management device.

When the one or more containers 12 are positioned on the support structure 14, one or more discharge gates 40 of one or more of the containers 12 may be opened, allowing bulk material 38 to flow from the containers 12 into the outlet 18 of the support structure 14. The outlet 18 may then route the flow of bulk material 38 directly into a blender inlet (for example, into the hopper 22 or mixer 24) of the blender unit 20.

After one or more of the containers 12 on the support structure 14 are emptied, the empty container(s) 12 may be removed from the support structure 14 via a hoisting mechanism. In some embodiments, the one or more empty containers 12 may be positioned on another storage area 32 (for example, a transportation unit, a skid, a pallet, or some other holding area) until they can be removed from the site, refilled or both. In other embodiments, the one or more empty containers 12 may be positioned directly onto a transportation unit for transporting the empty containers 12 away from the site. It should be noted that the same transportation unit used to provide one or more filled containers 12 to the location may then be utilized to remove one or more empty containers 12 from the site.

Figure 2:
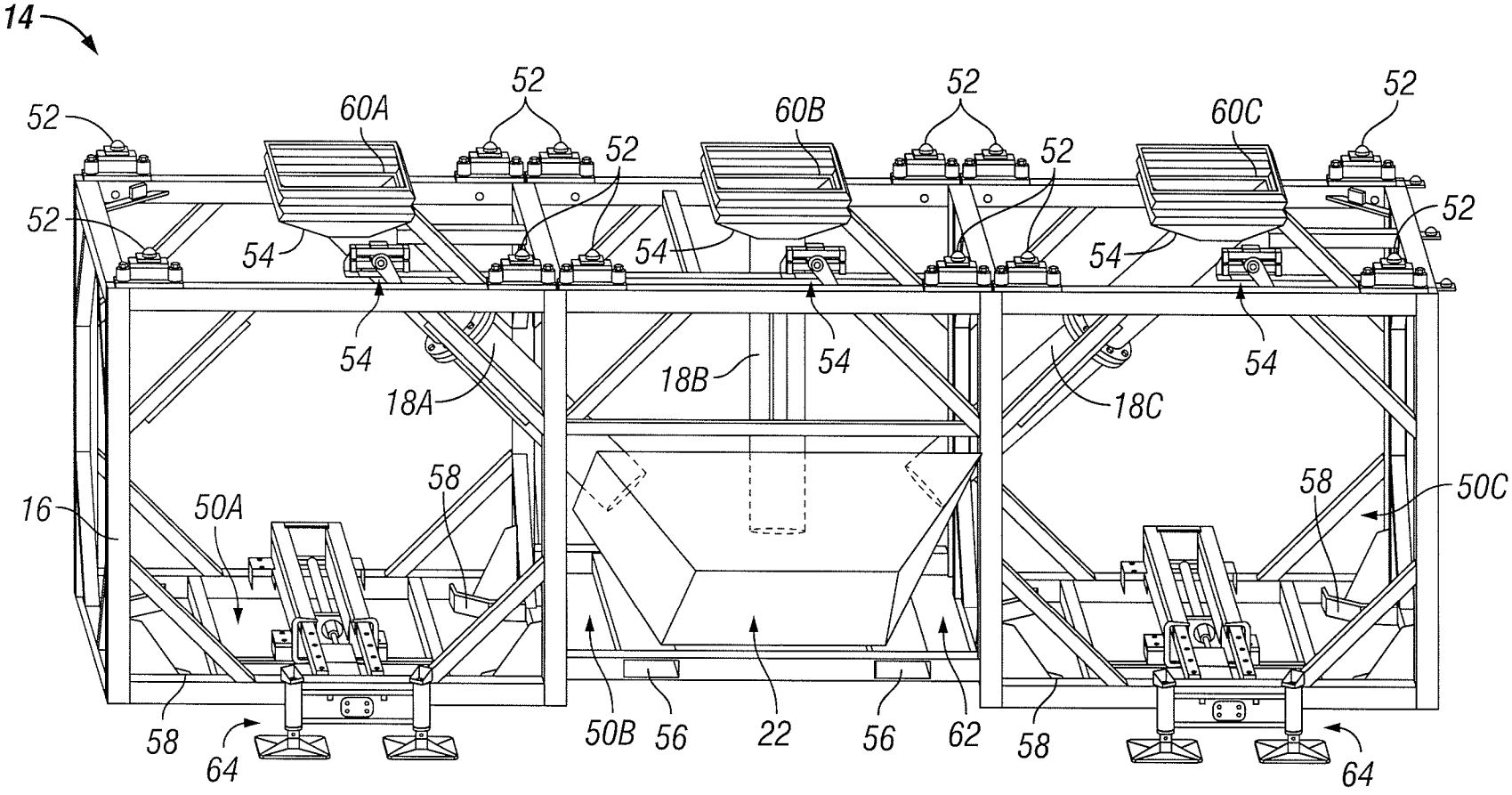
FIG. 2 is a perspective view of a container support structure in accordance with one or more aspects of the present disclosure.

FIG. 2 is a perspective view for a container support structure that may be used in accordance with one or more aspects of the present disclosure. FIG. 2 illustrates an embodiment of the support structure 14 that may be designed to receive multiple containers, for example, containers 12 illustrated in FIG. 1. Specifically, the support structure 14 includes a frame 16 sized to receive and support up to three portable or removable containers 12. The frame 16 may include several beams connected together (for example, via welds, rivets or bolts) to form a continuous group of cubic or rectangular shaped supports 50 coupled end to end. For example, in the illustrated embodiment, the frame 16 generally includes one continuous, elongated rectangular body broken into three distinct cubic/rectangular supports 50A, 50B, and 50C. Each cubic/rectangular support 50 may be used to support a single container 12. The frame 16 may include additional beams that function as trusses to help support the weight of the filled containers 12 disposed on the frame 16. Other shapes, layouts, and constructions of the frame 16 may be used in one or more embodiments. In addition, other embodiments of the support structure 14 may include a frame 16 sized to receive any number (for example, 1, 2, 4, 5, 6, 7, or more) or portable containers 12.

As illustrated, the support structure 14 may be equipped with a plurality of locator pins 52 disposed on top of the frame 16 for locating and holding the containers 12 on the frame 16. The containers 12 may include complementary engagement features designed to interface with the locator pins 52, thus enabling a precise placement of the containers 12 into desired locations on the frame 16. In the illustrated embodiment, the locator pins 52 are generally disposed at the corners on the upper face of each cubic/rectangular support 50. However, other placements of the locator pins 52 along the upper surface of the support structure 16 may be utilized in other embodiments.

The support structure 14 may also include one or more actuators 54 designed to aid in actuation of a discharge gate 40 of the one or more containers 12 disposed on the frame 16. In the illustrated embodiment, the actuators 54 may be rotary actuators designed to rotate into engagement with a discharge gate 40 of a container 12 to transition the discharge gate 40 between a closed position and an open position. In other embodiments, the actuators 54 may be linear actuators designed to interface with the discharge gates 40 of the containers 12 to selectively open and close the discharge gates 40. In some embodiments, the actuators 54 may include a set of two actuators (disposed on opposite sides of the frame 16) for actuating the discharge gate 40 of a single container 12 disposed on the frame 16. In such an arrangement, one of the actuators 54 may transition the discharge gate 40 from closed to open, while the opposite actuator 54 may transition the gate from open to closed.

The illustrated support structure 14 may be transportable to and from a desired or predetermined location on a flatbed trailer or some other transportation unit. Alternately, the support structure could be built into the trailer chassis so that the support structure is its own transportation unit. Once at a location, a hoisting mechanism (for example, forklift, crane, etc.) (not shown) may be used to remove the support structure 14 from the transportation system unit and to place the support structure 14 into a desired or predetermined position. To that end, the support structure 14 may include slots 56 that a forklift can engage to lift and manipulate the portable support structure 14 about the site. In the illustrated embodiment, the slots 56 are formed in a section of the frame 16 that is slightly elevated above a lower edge of the support structure 14. This may enable relatively easy release of the forklift from the support structure 14 once the support structure 14 is positioned on the ground or predetermined location. The slots 56 may be formed through a central portion (for example, central cubic/rectangular support 50B) of the elongated support structure 14 to keep the weight of the support structure 14 evenly distributed during movement at the site or predetermined location. In other embodiments, the support structure 14 may include other types of mechanical features for interfacing with another type of hoisting mechanism. For example, the support structure 14 may include one or more lifting eyes (not shown) for interfacing with a crane (not shown) used to position the support structure 14 as needed at the site or predetermined location.

Once the forklift (or other hoisting mechanism) brings the support structure 14 to a desired location at the site, the hoisting mechanism may lower the support structure 14 onto the ground or a relatively flat loading area proximate the ground level, or other predetermined location. The frame 16 may include corner supports 58 for distributing a weight of the support structure 14 (and any containers 12 disposed thereon) along the ground surface or predetermined location. As shown, the corner supports 58 may be disposed along the lower surface of the frame 16 at various corners of the cubic/rectangular supports 50. In the illustrated embodiment, for example, the corner supports 58 may be disposed at the lower corners of the two outside cubic/rectangular supports 50A and 50C, since the lower surface of the central support 50B is slightly elevated above the ground level.

As described above, the support structure 14 may include several outlets 18 for routing bulk material 38 directly from one or more containers 12 disposed on the frame 16 into a blender inlet. The term "blender inlet" used herein may refer to any number of inlets to tubs, hoppers, mixers, and other areas where bulk material is needed. As mentioned above, the blender inlet may be associated with a blender unit 20 disposed at a job site (for example, at a well site). For example, the blender inlet may be a blender hopper (for example, hopper 22 of FIG. 1) used to provide bulk material 38 to a metering system that meters the bulk material into a mixer 24. In other embodiments, the blender inlet may be an inlet directly into a mixing vessel (for example, mixer 24 of FIG. 1) of a blender unit 20. Other embodiments may utilize other types of blender inlets for receiving the bulk material 38 from a container 12 disposed on the support structure 14.

In the illustrated embodiment, the blender unit 20 and support structure 14 may be designed such that the support structure 14 routes bulk material 38 directly from a container 12 into the blender hopper 22. The "blender inlet" may correspond to the blender hopper 22. In FIG. 2, the blender hopper 22 is shown schematically without showing the rest of the blender unit 20 (for example, mixing compartment, sand screws for transporting bulk material from the hopper 22 to the mixer 24, or any other suitable unit). Again, it should be noted that other embodiments of the blender unit 20 may feature other types of blender inlets into which the outlets 18 are designed to route bulk material 38 from one or more containers 12.

The outlets 18A, 18B, and 18C may be used to deliver a flow of bulk material 38 to the blender hopper 22 (or other blender inlet) from each of three respective containers 12 disposed on the frame 16. In some embodiments, the support structure 14 may also include individual hoppers 60A, 60B, and 60C at the top of the frame 16 for funneling bulk material 38 from the discharge gate 40 of the corresponding containers 12 into the outlets 18A, 18B, and 18C, respectively.

In one or more embodiments, the outlets 18 may be positioned such that the lower end of each of the gravity feed outlets 18 is disposed fully within the blender hopper 22. This allows the outlets 18 to provide bulk material 38 from all of the containers 12 positioned on the frame 16 into the same blender inlet (for example, blender hopper 22) at or near the same time. The outlets 18 may provide a gravity feed where an angle of repose of the bulk material 38 exiting the outlets 18 is able to choke the flow of bulk material 38 through the outlets 18. As bulk material 38 is metered from the blender hopper 22 into another portion of the blender unit 20 (for example, mixer 24), additional bulk material 38 flows via gravity into the blender hopper 22 directly from the one or more gravity feed outlets 18. In embodiments where the outlets 18 are positioned to route bulk material 38 directly from the containers 12 into an inlet of the mixer 24 of the blender unit 20, the gravity feed outlets 18, the blender inlet, or both may feature a metering gate/valve that regulates the amount of bulk material 38 provided to the mixer 24 (for example, instead of separate sand screws)

In some instances, the support structure 14 may be equipped with a set of outriggers 64 to increase the stability of the portable support structure 14. The outriggers 64 may help to keep the support structure 14 stable in the event of high winds or the support structure 14 being impacted by a container, forklift, blender, or other pieces of equipment at the job site. In addition, the outriggers 64 on the support structure 14 may be used for interfacing with the blender unit 20 to bring the blender inlet into a desired position or alignment within the opening 62 of the support structure 14.

Figure 3:
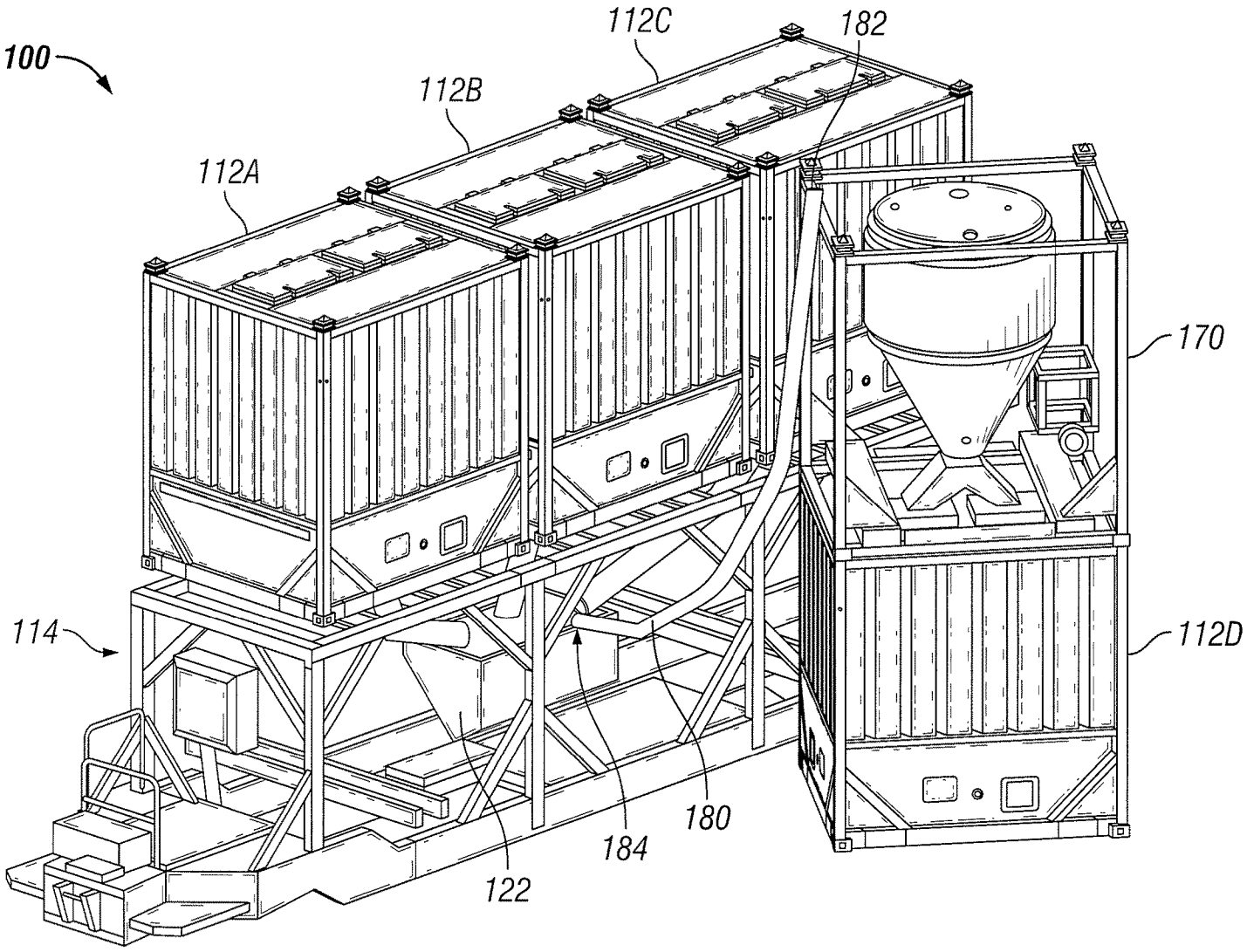
FIG. 3 is a perspective view of a bulk material handling and recovery system in accordance with one or more aspects of the present disclosure.

FIG. 3 is a perspective view of bulk material handling system 100 according to certain aspects of the present disclosure, which may be similar to system 10 shown in FIG. 2. System 100 includes an embodiment of a support structure 114 (similar to support structure 14 shown in FIG. 2) on which containers 112A, 112B, and 112C have been placed that each contain one or more bulk materials. Containers 112A, 112B, and 112C may have been used to dispense bulk material into a blender inlet as described above. For example, in the embodiment shown, containers 112A, 112B, and 112C may dispense bulk material into an inlet of blender hopper 122.

System 100 further includes an empty container 112D that has a structure substantially similar to one or more of containers 112A, 112B, and 112C, the structures of which are illustrated in further detail in FIG. 4 and described below. In certain embodiments, empty container 112D may contain some amount of bulk material, but has at least some "empty" space into which additional bulk material may be deposited. For example, the interior space of empty container 112D may be only partially filled with bulk material. In some embodiments, empty container 112D may comprise multiple internal compartments (not shown), only some of which are presently filled with bulk material.

System 100 also includes a skid-mounted vacuum unit 170 that is placed on top of empty container 112D, and may provide a source of vacuum that can be used to remove bulk material remaining in a portion of the blender unit (e.g., the blender hopper 122). Vacuum unit 170 is illustrated in further detail in FIG. 5 and described below. System 100 also includes a conduit 180 having an end 182 connected to the vacuum unit 170 and an end 184 that is coupled to or otherwise placed in fluid communication with the blender inlet (e.g., an inlet of the blender hopper 122). In some embodiments, end 184 of the conduit 180 simply may be held in communication with the blender inlet. In some embodiments, end 184 of the conduit 180 may include a connector, wand, or flange that is configured to be coupled to the blender inlet so as to form a sealed connection at the blender inlet, which may minimize the amount of particulates and/or dust expelled from the blender unit into the air while using the recovery system of the present disclosure.

After a job using the blender unit to blend bulk material into a fluid is completed, the system 100 and techniques according to the present disclosure may be used to recover any solid bulk material remaining in the blender unit. In particular, once the vacuum unit 170 is placed on empty container 112D and connected to the blender inlet as shown in FIG. 3, a vacuum pump on the vacuum unit 170 may be activated to create a sufficient suction force and air velocity such that any solid bulk material present in the blender unit (e.g., mixer 24, hopper 22, etc.) is fed through the conduit 180 and is deposited into the empty container 112D. This may be accomplished without the use of a liquid carrier fluid to suspend the solid bulk material. Any solid bulk material recovered into empty container 112D may be stored and used in subsequent treatment operations. For example, in some embodiments the container 112D subsequently may be positioned on the support structure 114 such that the recovered bulk material may be dispensed into the same blender hopper 122 from which it was recovered. In other embodiments, container 112D may be transported to blender at another job site or location where the recovered bulk material may be used.

Figure 4:
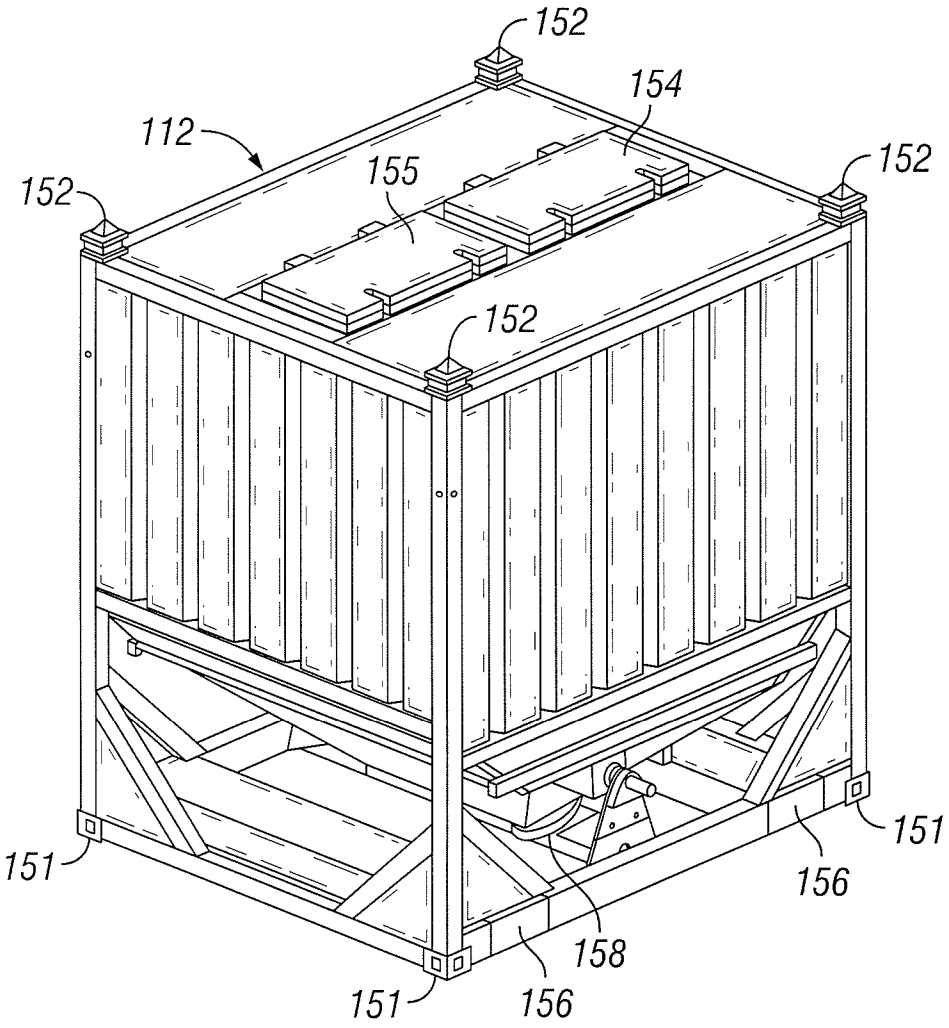
FIG. 4 is a perspective view of a bulk material container in accordance with one or more aspects of the present disclosure.

FIG. 4 is a perspective view of a container 112 according to certain aspects of the present disclosure. One or more of containers 112A-112D shown in FIG. 3 may have this structure. Container 112 generally includes an interior enclosure (not shown) in which bulk material may be kept. In the embodiment shown, container 112 also includes inlets 154 and 155 on the top surface of the container through which the bulk material may enter the enclosure, which may be selectively opened or closed with one or more hatches thereon. In certain embodiments where the interior enclosure of 112 is divided into multiple compartments, inlets 154 and 155 may open into different compartments. Container 112 also includes an outlet 158 on the bottom of the container through which bulk material may be dispensed, which may be equipped with one or more discharge gates 40 as shown in FIG. 1 and discussed above. Container 112 also may include slots 156 that a forklift can engage to lift and manipulate the container 112 about the site. As shown and discussed above, container 112 may be equipped with engagement features 151 on the bottom of container 112 that are designed to interface with the locator pins 52 on the top of frame 16 of the support structure 14 when the container 112 is placed on top of the support structure 14. Container 112 also may be equipped with locator pins 152 on the top of container 112 that are designed to interface with complementary engagement features on the vacuum unit 170 discussed below. In the illustrated embodiment, the engagement features 151 and locator pins 152 are generally disposed at the corners on bottom and top of container 112, respectively. However, other placements of the engagement features 151 and locator pins 152 along the bottom and top surfaces of the container 112 may be utilized in other embodiments. Of course, FIG. 4 illustrates only one embodiment of a container according to the present disclosure; containers of other shapes, sizes, layouts, and configurations are possible and contemplated within the scope of the present disclosure. For example, the inlets and outlets of the container may be located in other places on the container (e.g., in a side wall of the container or in an upper or lower portion of the container that is not in a top or bottom surface of the container).

Figure 5:
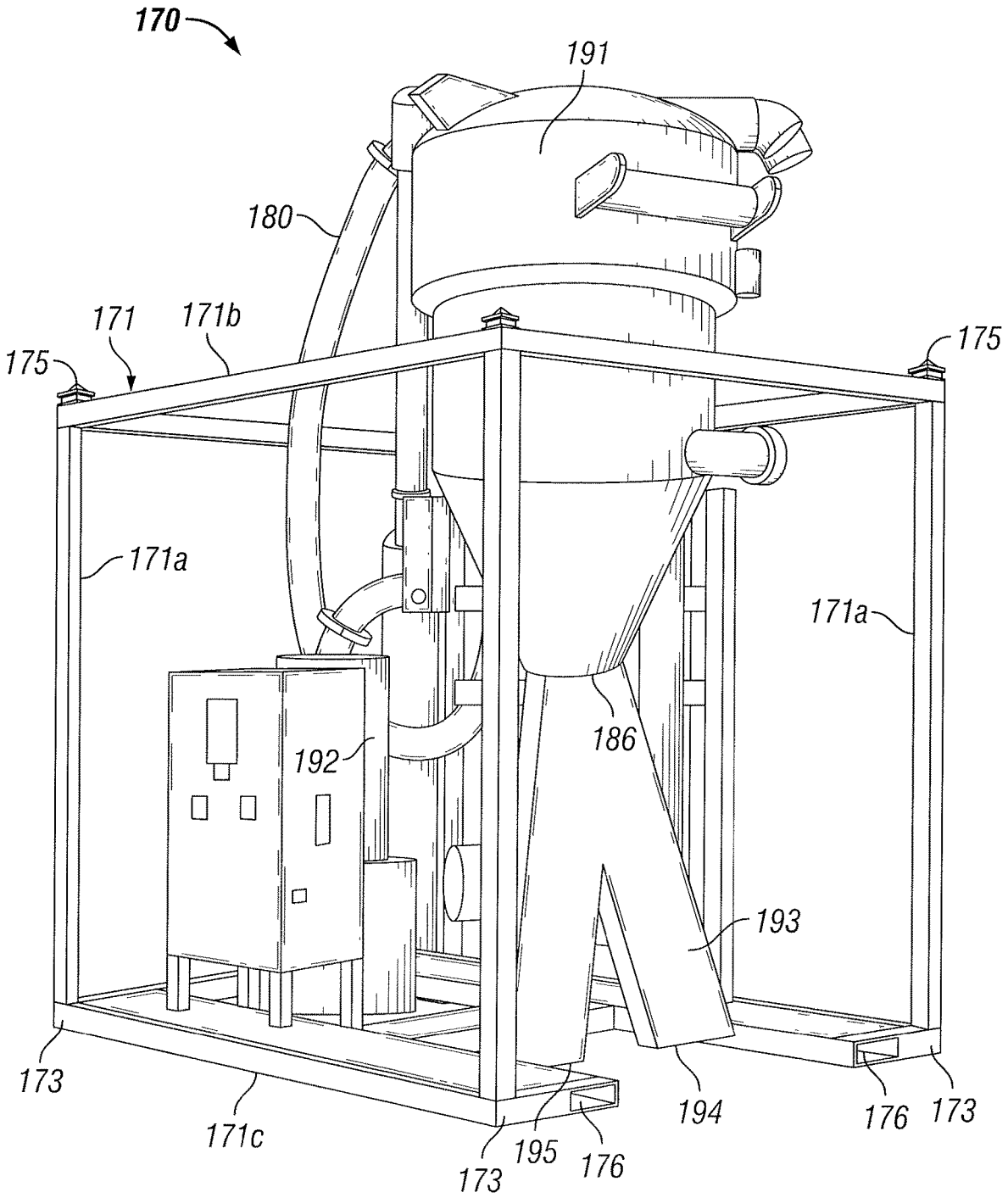
FIG. 5 is a perspective view of a skid-mounted vacuum unit in accordance with one or more aspects of the present disclosure.

FIG. 5 is a perspective view of a skid-mounted vacuum unit 170 according to certain aspects of the present disclosure. Vacuum unit 170 generally includes a tank 191 that is negatively pressurized by a vacuum pump 192 in communication with the interior of tank 191, which may comprise any known industrial vacuum source or vacuum equipment suitable for collection of solid particulate materials. For example, examples of industrial vacuum equipment that may be suitable in certain embodiments include the Hurricane™ line of vacuum equipment available from Industrial Vacuum Equipment Corporation of Ixonia, Wis. Moreover, tank 191 may be of any suitable size, shape, and/or configuration. Conduit 180 is also shown with one end 182 connected to an inlet of the tank 191. An outlet 186 of the tank 191 is also equipped with a chute 193 having outlets 194 and 195 that are configured to interface with inlets 154 and 155 of container 112 shown in FIG. 4 when the vacuum unit 170 is placed on top of the container 112. In some embodiments, chute 193 may be designed to feed bulk material selectively into only one of inlet 154 or 155 of container 112, for example, using a damper or other control mechanism. In other embodiments, chute 193 may feed bulk material into both inlets 154 and 155 of container 112 simultaneously. In some embodiments, the outlet 186 of the tank 191 or outlets of the chute 193 may be equipped with one or more devices (not shown) that are configured to make a sealed connection with the inlet of the container (e.g., a rotary airlock), which may allow bulk material to be discharged from the outlet without loss of vacuum pressure in the tank and/or may reduce or prevent the escape of bulk material and/or dust into the air.

According to the embodiment shown, the tank 191 is mounted in a skid frame 171 that has the same footprint dimensions as container 112, and is configured to be stacked on top of the container 112. In particular, skid frame 171 comprises an upper frame 171*b*, vertical supports 171*a*, and bottom rails 171*c* that surround and support the tank 191. Bottom rails 171*c* are configured to be placed on a top surface of a container 112. In particular, bottom rails 171*c* may be equipped with engagement features 173 that are designed to interface with the locator pins 152 on the top of container 112 when the vacuum unit 170 is placed on top of container 112. Bottom rails 171*c* also may include slots 176 that a forklift can engage to lift and manipulate the vacuum unit 170 about the site (e.g., when lifting vacuum unit 170 and placing it on top of a container). Moreover, upper frame 171*b* may be equipped with locator pins 175 that are designed to interface with engagement features on the bottom of a container or other vacuum unit when it is placed on top of vacuum unit 170. Of course, FIG. 5 illustrates only one embodiment of a skid-mounted vacuum unit 170 according to the present disclosure; containers of other shapes, sizes, layouts, and configurations are possible and contemplated within the scope of the present disclosure. For example, the outlet of the tank 191 may be located somewhere other than the lower portion of the pump, as long as the contents of tank 191 may be discharged through the outlet via gravity, and the chute 193 located at the outlet of the pump may be mounted horizontally, vertically, or at any angle, depending on the particular application in which it will be used (e.g., the configuration of the container with which it will interface to recover the solid bulk material).

Although the present disclosure and its advantages have been described in detail, it should be understood that various changes, substitutions and alterations can be made herein without departing from the spirit and scope of the disclosure as defined by the following claims.

What is claimed is:

1. A system, comprising:

a blender having a blender inlet and a mixing compartment for mixing dry bulk material with a liquid to generate a treatment fluid;

at least one container having an interior space in which dry bulk material can be placed, at least one inlet, and at least one outlet through which the dry bulk material in the interior space can be dispensed to the blender inlet;

a skid-mounted vacuum unit, wherein the vacuum unit comprises:

a tank having an interior space and an outlet for interfacing with the inlet of the container when the vacuum unit is positioned proximate to the container, a vacuum pump in communication with the interior space of the tank, and a conduit coupled to an inlet of the tank for interfacing with the blender inlet, wherein the outlet of the tank is a gravity feed outlet extending in an at least partially downward direction from the tank for outputting bulk material from the tank.

2. The system of claim 1 wherein:

at least one inlet of the container is disposed in an upper portion of the container and at least one outlet of the container is disposed in a lower portion of the container; and the outlet of the tank is disposed in a lower portion of the tank.

3. The system of claim 1 wherein the skid-mounted vacuum unit comprises a skid frame for resting the vacuum unit on the top of the container such that the outlet of the tank interfaces with at least one inlet of the container.

4. The system of claim 1 wherein the container comprises one or more engagement features for interfacing with one or more complementary engagement features on the skid-mounted vacuum unit.

5. The system of claim 1 wherein dry bulk material is not mixed with or suspended in a liquid.

6. The system of claim 1, wherein:

the container has two inlets; and the outlet comprises a chute with two outlets extending in an at least partially downward direction from the tank for outputting bulk material from the tank to the two inlets.

7. A system, comprising:

a blender having a blender inlet and a mixing compartment for mixing dry bulk material with a liquid to generate a treatment fluid;

at least one container having an interior space in which dry bulk material can be placed, the container having at least one inlet in an upper portion of the container and at least one outlet in a lower portion of the container;

a support structure for holding at least one container of dry bulk material at a position proximate to the blender inlet, wherein the support structure comprises:

a frame for receiving and holding the at least one container thereon; and a gravity feed outlet coupled to the frame for routing the dry bulk material from the at least one container into the blender inlet;

a skid-mounted vacuum unit, wherein the vacuum unit comprises:

a tank having an interior space and an outlet for interfacing with the inlet of the container when the vacuum unit is positioned proximate to the container, a vacuum pump in communication with the interior space of the tank, and a conduit coupled to an inlet of the vacuum pump for interfacing with the blender inlet, wherein the outlet of the tank is a gravity feed outlet extending in an at least partially downward direction from the tank for outputting bulk material from the tank.

8. The system of claim 7, wherein the support structure is removably disposed over the blender inlet of the blender.

9. The system of claim 7, wherein the support structure comprises outriggers for positioning or aligning the blender inlet relative to the portable support structure.

10. The system of claim 7, wherein the support structure comprises the gravity feed outlet for routing the dry bulk material into the blender inlet without the use of pneumatic or mechanical conveyance equipment.

11. The system of claim 7, wherein the support structure comprises:

a frame for receiving and holding a plurality of portable containers of dry bulk material; and a plurality of gravity feed outlets coupled to the frame, each of the plurality of gravity feed outlets being positioned to route the dry bulk material from a corresponding one of the plurality of portable containers directly into the blender inlet.

12. The system of claim 11, wherein the plurality of gravity feed outlets of the support structure are each angled to direct the dry bulk material from the corresponding plurality of portable containers into the blender inlet.

13. The system of claim 7, wherein the portable support structure is transportable on a trailer and comprises engagement features for interfacing with a hoisting mechanism.

14. The system of claim 7, wherein the portable support structure further comprises a gate actuator for selectively actuating a discharge gate of the at least one portable container for releasing the dry bulk material from the at least one portable container into the at least one gravity feed outlet of the support structure.

15. A method of recovering dry bulk material from a blender at a job site, the blender having a blender inlet and a mixing compartment for mixing dry bulk material with a liquid to generate a treatment fluid, the method comprising:

providing a skid-mounted vacuum unit at the job site, wherein the vacuum unit comprises:

a tank having an interior space and an outlet;

a vacuum pump in communication with the interior space of the tank; and a conduit coupled to an inlet of the tank;

interfacing the conduit of the vacuum unit with the blender inlet;

with the vacuum unit positioned proximate to a container, interfacing the outlet of the tank with an inlet of the container, the container having an interior space in which dry bulk material can be placed, and the container further comprising at least one outlet through which the dry bulk material in the interior space can be dispensed to the blender inlet;

wherein the outlet of the tank is a gravity feed outlet extending in an at least partially downward direction from the tank for outputting bulk material from the tank; and activating the vacuum pump to feed dry bulk material from the blender inlet through the tank and into the interior space of the container.

16. The method of claim 15 wherein the dry bulk material fed into the interior space of the container is not mixed with or suspended in a liquid.

17. The method of claim 15 further comprising, after using the vacuum pump to feed dry bulk material into the interior space of the container:

positioning the container on a support structure having a gravity feed outlet for routing the dry bulk material from the container into a treatment fluid blender;

dispensing the dry bulk material from the container into the treatment fluid blender; and using the treatment fluid blender to mix the dry bulk material with at least a liquid to generate a treatment fluid.

18. The method of claim 17 wherein the treatment fluid blender is the blender at the job site.

19. The method of claim 15 wherein:

the inlet of the container is disposed in an upper portion of the container and the at least one outlet of the container is disposed in a lower portion of the container; and the outlet of the tank is disposed in a lower portion of the tank.

20. The method of claim 15 further comprising positioning the skid-mounted vacuum unit on top of the container such that the outlet of the tank interfaces with the inlet of the container.

* * * * *